US008418855B2

(12) United States Patent
Rem et al.

(10) Patent No.: US 8,418,855 B2
(45) Date of Patent: Apr. 16, 2013

(54) METHOD AND APPARATUS FOR THE SEPARATION OF SOLID PARTICLES HAVING DIFFERENT DENSITIES

(75) Inventors: Peter Carlo Rem, Rijswijk (NL); Simon Peter Maria Berkhout, Delft (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 12/870,099

(22) Filed: Aug. 27, 2010

(65) Prior Publication Data

US 2011/0042274 A1 Feb. 24, 2011

Related U.S. Application Data

(63) Continuation of application No. PCT/NL2009/050016, filed on Jan. 16, 2009.

(30) Foreign Application Priority Data

Feb. 27, 2008 (NL) ..... 2001322

(51) Int. Cl.
*B03C 1/30* (2006.01)

(52) U.S. Cl.
USPC ..... 209/39; 209/3; 209/155; 209/212

(58) Field of Classification Search ..... 209/213–232, 209/3, 12.1, 12.2, 38, 39, 40, 132
See application file for complete search history.

(56) References Cited

U.S. PATENT DOCUMENTS

| | | | |
|---|---|---|---|
| 1,522,343 | A | 1/1925 | Thom |
| 2,056,426 | A | 10/1936 | Frantz |
| 2,291,042 | A | 7/1942 | Kennedy |
| 2,690,263 | A | 9/1954 | Box et al. |
| 3,057,477 | A | 10/1962 | Rappaport |
| 4,062,765 | A | 12/1977 | Fay et al. |
| 4,069,145 | A | 1/1978 | Sommer |
| 4,083,774 | A | 4/1978 | Hunter |

(Continued)

FOREIGN PATENT DOCUMENTS

| | | |
|---|---|---|
| AU | 726763 | 11/2000 |
| DE | 729487 | 12/1942 |

(Continued)

*Primary Examiner* — Joseph C Rodriguez
*Assistant Examiner* — Kalyanavenkateshware Kumar
(74) *Attorney, Agent, or Firm* — Jeffrey D. Myers; Peacock Myers, P.C.

(57) ABSTRACT

A method and apparatus for separating solid particles of different densities, using a magnetic process fluid. The solid particles are thoroughly mixed in a small partial flow of the process fluid. The small turbulent partial flow is added to a large laminar partial flow of the process fluid, after which the obtained mixture of the respective partial process fluids is conducted over, under, or through the middle of two magnet configurations, wherein the particles are separated into lighter particles at the top of the laminar process fluid and heavier particles at the bottom of the laminar process fluid, each of which are subsequently removed with the aid of a splitter. After that furthermore the particles of low density and the particles of high density are separated from the respective process streams, dried and stored. Finally, the process fluid from which the particles have been removed is returned to the original starting process stream. The method according to the invention is especially suitable, for example, for separating a mixture of polypropylene particles and polyethylene particles.

12 Claims, 3 Drawing Sheets

U.S. PATENT DOCUMENTS

| | | | | |
|---|---|---|---|---|
| 4,324,657 | A | 4/1982 | Garrett | |
| 4,621,928 | A | 11/1986 | Schjreiber | |
| 4,623,470 | A | 11/1986 | Adler | |
| 4,743,364 | A | 5/1988 | Kyrazis | |
| 4,874,507 | A | 10/1989 | Whitlock | |
| 5,011,022 | A | 4/1991 | Palepu et al. | |
| 5,224,604 | A | 7/1993 | Duczmal et al. | |
| 5,957,298 | A * | 9/1999 | Buske et al. | 209/39 |
| 5,968,820 | A | 10/1999 | Zborowski et al. | |
| 6,138,833 | A | 10/2000 | Matsufuji et al. | |
| 6,568,612 | B1 | 5/2003 | Aoki et al. | |
| 6,708,828 | B2 | 3/2004 | Miles | |
| 6,822,180 | B2 * | 11/2004 | Fujii et al. | 209/128 |
| 7,741,574 | B2 * | 6/2010 | Stencel et al. | 209/128 |
| 2003/0044832 | A1 * | 3/2003 | Blankenstein | 435/6 |
| 2003/0165812 | A1 | 9/2003 | Takayama et al. | |
| 2004/0050756 | A1 | 3/2004 | Flagan | |
| 2009/0047297 | A1 | 2/2009 | Kim et al. | |
| 2009/0301296 | A1 | 12/2009 | Hoijtink et al. | |
| 2011/0042274 | A1 | 2/2011 | Rem et al. | |
| 2011/0049017 | A1 | 3/2011 | Rem et al. | |
| 2012/0085684 | A1 | 4/2012 | Rem et al. | |

FOREIGN PATENT DOCUMENTS

| | | |
|---|---|---|
| DE | 1051752 | 3/1959 |
| DE | 4014969 | 5/1990 |
| DE | 102004040785 | 3/2006 |
| DE | 102005032661 | 7/2007 |
| EP | 1181982 | 2/2002 |
| EP | 1800753 | 6/2007 |
| EP | 1878505 | 1/2008 |
| FR | 1348410 | 12/1964 |
| GB | 1602279 | 11/1981 |
| GB | 679277 | 9/2005 |
| OA | 392 | 10/1964 |
| WO | WO-0126793 | 4/2001 |
| WO | WO-03053588 | 7/2003 |
| WO | WO-2006021410 | 3/2006 |
| WO | WO-2006138314 | 12/2006 |

* cited by examiner

METHOD AND APPARATUS FOR THE SEPARATION OF SOLID PARTICLES HAVING DIFFERENT DENSITIES

CROSS-REFERENCE TO RELATED APPLICATIONS

This application is a continuation application of International Patent Application Serial No. PCT/NL2009/050016 entitled "Method and Apparatus for the Separation of Solid Particles Having Different Densities", to Technische Universiteit Delft, filed on Jan. 16, 2009, which is a continuation of Netherlands Patent Application Serial No. 2001322, entitled "Method and Apparatus for the Separation of Solid Particles Having Different Densities", to Technische Universiteit Delft, filed on Feb. 27, 2008, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention

The invention relates to a method and apparatus for separating solid particles of different densities, using a magnetic process fluid.

2. Description of Related Art

Such a method is known from the Dutch patent 1 030 761. This patent describes a method and apparatus for separating solid particles in a magnetic process fluid, wherein the magnetic fluid is conducted through a magnetic field, generated by means of permanent magnets.

It should be noted that this known method and apparatus is indeed suitable for separating solid particles of greatly differing densities, wherein the density difference of the solid particles may be 1000 kg/m$^3$ or more as for example, copper at 8900 kg/m$^3$ in comparison with aluminum at 2700 kg/m$^3$. Such particles are separated from each other by strong forces with the result that turbulence in the process fluid, or the possibility of clustering particles due to sedimentation, hardly influence the separation of the solid particles.

When separating solid particles such as plastic particles, seeds and diamonds of slight differences in density, in the order of up to 10 kg/$^3$, turbulence in the process fluid or clustering of particles due to sedimentation have been shown to be very disadvantageous.

The known methods and apparatuses are not suitable for the separation of solid particles of slight differences in density, in the order of up to 10 kg/$^3$, such as solid polypropylene and solid polyethylene particles.

BRIEF SUMMARY OF THE INVENTION

It is the object of the invention to provide a method and apparatus with which the drawbacks of the known method and apparatus are removed in an effective manner.

Surprisingly, it was shown that this problem can be solved by conducting two separate partial flows of process fluid into the magnetic field, with the considerably larger partial flow consisting of the magnetic process fluid without particles, flowing in under laminar conditions, whereas the second, considerably smaller partial flow, is added to the process fluid in a turbulent state and mixed with the particles to be separated.

It has been shown that through the present invention the turbulence of the total fluid stream in the magnetic field is limited to a minimum, while in addition allowing the particles to start at or near the height of the splitter, such that the distance they have to travel (in the vertical direction) in order to be recovered at the desired side of the splitter, is minimal.

BRIEF DESCRIPTION OF THE SEVERAL VIEWS OF THE DRAWINGS

The invention is further elucidated by means of the accompanying FIGS. 1-3.

DETAILED DESCRIPTION OF THE INVENTION

Figure 1:
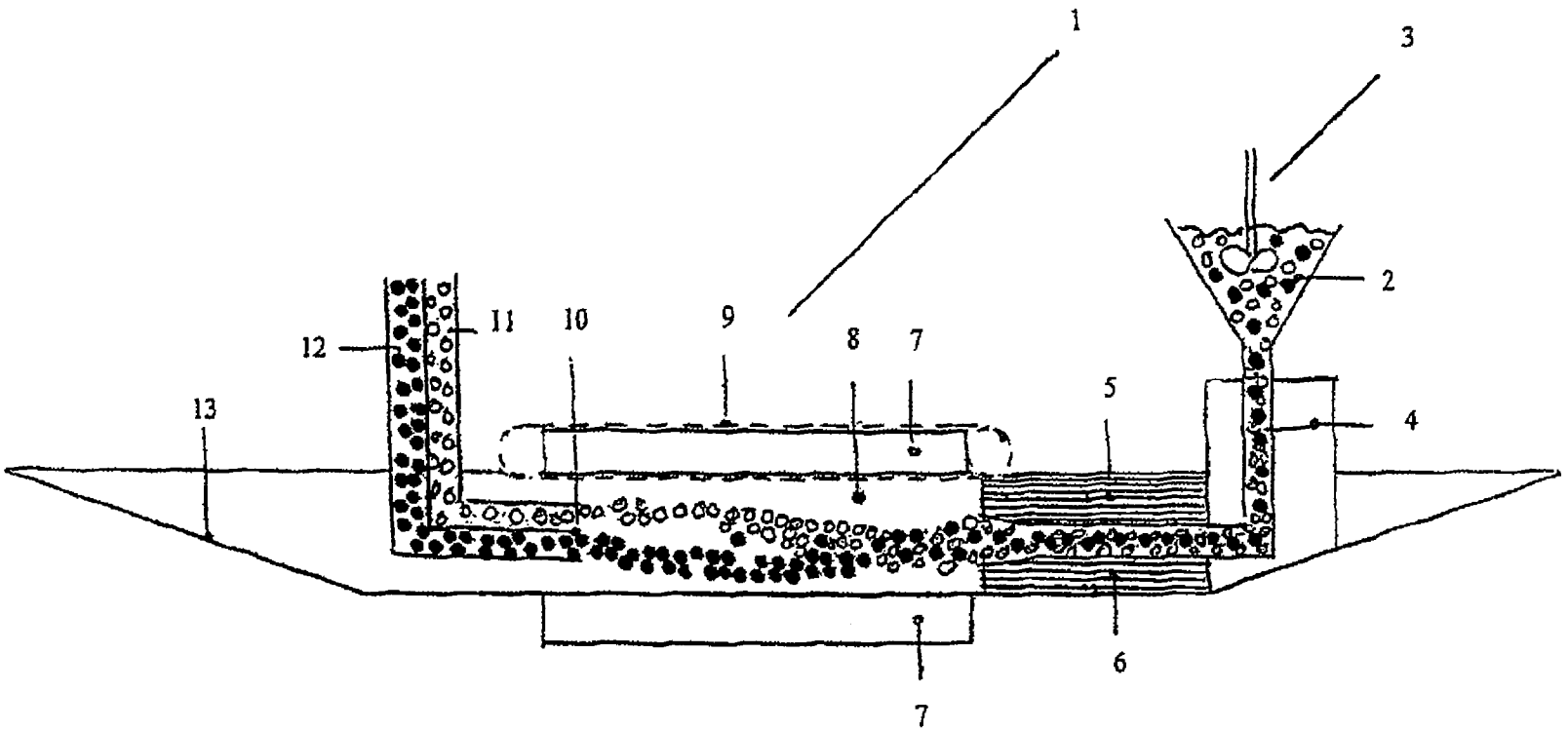
FIG. 1 shows a preferred embodiment of the apparatus according to the invention.

The present invention fulfils the ever increasing need to separate solid particles of small density differences such as plastic materials, seeds, diamonds, etc., having a density difference of only up to 10 kg/$^3$.

To this end the present invention provides a method for the separation of solid particles of different densities in a magnetic process fluid, wherein the solid particles that differ little in density are separated by first thoroughly mixing the solid particles to be separated in a small partial flow of the process fluid, which small turbulent partial flow is added to a large laminar partial flow of the process fluid, after which the obtained mixture of the respective partial process fluids is conducted over, under, or through the middle of two magnet configurations, wherein the particles are separated into lighter particles at the top of the laminar process fluid and heavier particles at the bottom of the laminar process fluid, each of which are subsequently removed with the aid of a splitter, wherein furthermore the materials of low density and the materials of high density are separated from the respective process streams, dried and stored and finally, the process streams are returned to the original starting process fluid streams.

According to the present method it is essential that the solid particles of little density difference to be separated are separately mixed with each other in a significantly smaller partial process fluid stream before being added to the process fluid, which is in a laminar flow condition. The combined process fluids are subsequently conducted over, under, or through the middle of two magnet configurations, with the lighter particles ending up in the laminar process fluid, while the heavier particles move to a lower stratum of the laminar process fluid. The thus separated particles are subsequently removed with the aid of a splitter. The separated solid particles are then withdrawn from the respective process fluids and after drying they are collected and stored.

The process fluid from which the solid particles have been removed is then conducted back into the system for reuse.

The present method is especially suitable, for example, for separating polypropylene particles having a density of 880-920 kg/m$^3$ and solid polyethylene particles having a density of 930-960 kg/m$^3$. In the plastics industry there is an increasing need for the recovery of such materials, which can then be used anew in the plastic processing industry.

The process fluid according to the invention usually consists of a suspension of iron-oxide particles.

The partial process fluid to which the solid particles to be separated have been admixed, generally constitutes approximately 10% of the total process fluid.

In contrast with the Dutch patent 1 030 761, in which only the use of permanent magnets is mentioned, good separation results are obtained in accordance with the present method, by using permanent magnets, electromagnets or superconducting magnets.

The invention further relates to an apparatus for separating solid particles of little density difference in a magnetic process fluid, wherein the apparatus 1 is provided with a mixing vessel 2 for the solid particles to be separated in a small portion of the magnetic process fluid, which mixing vessel 2 is provided with a stirrer 3, wherein 4 denotes the turbulent small process fluid stream containing the particles, 5 and 6 are laminators for obtaining laminar process fluid, 8, 9 denote a rotating endless belt, 10 represents a splitter for dividing and removing the process fluid stream 11 containing the lighter particles on the one hand, and the process fluid stream 12 containing the heavier particles on the other hand. A simultaneously moving trough-shaped endless belt 13 serves to remove settled heavy particles and to maintain the laminar flow.

The mixing vessel 2 is, usually funnel-shaped, that is to say it tapers, and comprises a stirrer 3 for mixing the particles of small density difference with a small portion of the process fluid.

It is particularly useful to pre-moisten the solid particles, for example, with the aid of steam so as to, when mixing the particles into the turbulent fluid stream, prevent the adherence to the particles of air bubbles, which would make the particles effectively lighter and heavy particles would incorrectly be separated into the lighter product stream. The contact between the cool particles and the hot steam produces a microscopically thin layer of condensation on the entire surface of the particles, so that air bubbles are unable to adhere to the solid surface, which would interfere with the separation.

The laminators 5 and 6 are provided before the magnet 7. The laminators 5 and 6 generate a laminar process fluid stream 8, with the result that there is no, or hardly any, turbulence in the laminar process fluid stream 8, allowing an adequate separation to take place between the light particles and the heavier particles.

According to the invention, the magnet 7 may be a permanent, electro- or superconducting magnet.

FIG. 1 shows a preferred embodiment of the apparatus 1 according to the invention.

The apparatus 1 is provided with a tapering mixing vessel 2, in which a standard stirrer 3 is provided for thoroughly mixing the solid particles to be separated that have slightly differing densities, with the black particles being polyethylene (PE) particles and the white particles representing polypropylene (PP) particles. The process fluid 4 that is in the turbulent condition and containing the solid particles to be separated passes the laminators 5 and 6 and ends up in the laminar process fluid 8 between the magnets 7, in this case an electromagnet.

In order to realize a suitably laminar effect, the laminators 5 and 6 are preferably provided at the feed side of the fluid stream.

Examples of laminators include a porous material having a homogeneous permeability and a material having parallel channels oriented in the direction of flow.

Under the influence of the magnetic field a separation takes place between the polyethylene particles of higher density and the polypropylene particles of lower density. Approximately at the end of the magnets 7 the splitter 10 is located, preferably at the same level as the inlet opening of the turbulent process fluid stream. The splitter 10 ensures that the separated PP and PE particles 11 and 12, respectively, are removed and, after drying, stored for further use.

The process fluid containing the particles to be separated moves via an equidirectionally moving endless channel-shaped belt 13, which subsequently removes the settled particles and maintains the laminar flow.

Figure 2:
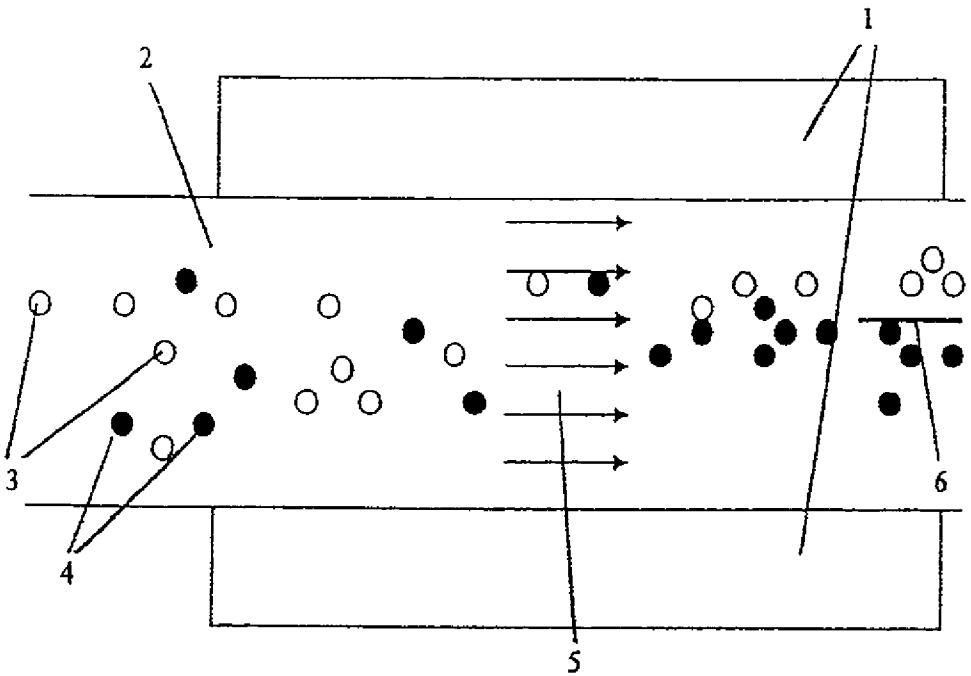
Prior Art FIG. 2
FIG. 2 is a schematic representation of the particle distribution during the prior art separating process.

FIG. 2 is a schematic representation of the particle distribution during the prior art separating process.

According to the prior art separating process as described in the Dutch patent 1 030 761, a slurry of plastic particles (PE) and (PP) and magnetic fluid are mixed and in turbulent condition introduced into the magnetic field between the magnets 1. The black particles 4 are heavier PE particles and the white particles 3 are the lighter PP particles.

The process fluid runs from left to right, as shown by the arrows 5. The splitter 6 is located at the end of the magnets 1.

The separation results show that the PP particles are not completely recovered in the light fraction, although in a laminar flow this ought to be the case. Apparently the flow is not sufficiently laminar in one part of the magnetic field, and/or from some of the starting positions, the particles have to travel too great a vertical distance from the position at which the particles flow into the field to the level of the splitter.

In accordance with the invention this problem is solved by conducting two separate fluid stream into the magnetic field. By far the largest fluid stream consists for approximately 90% of magnetic fluid without particles, being introduced under laminar conditions, while the second much smaller flow has a turbulence of approximately 10%, into which are mixed the particles to be separated.

Figure 3:
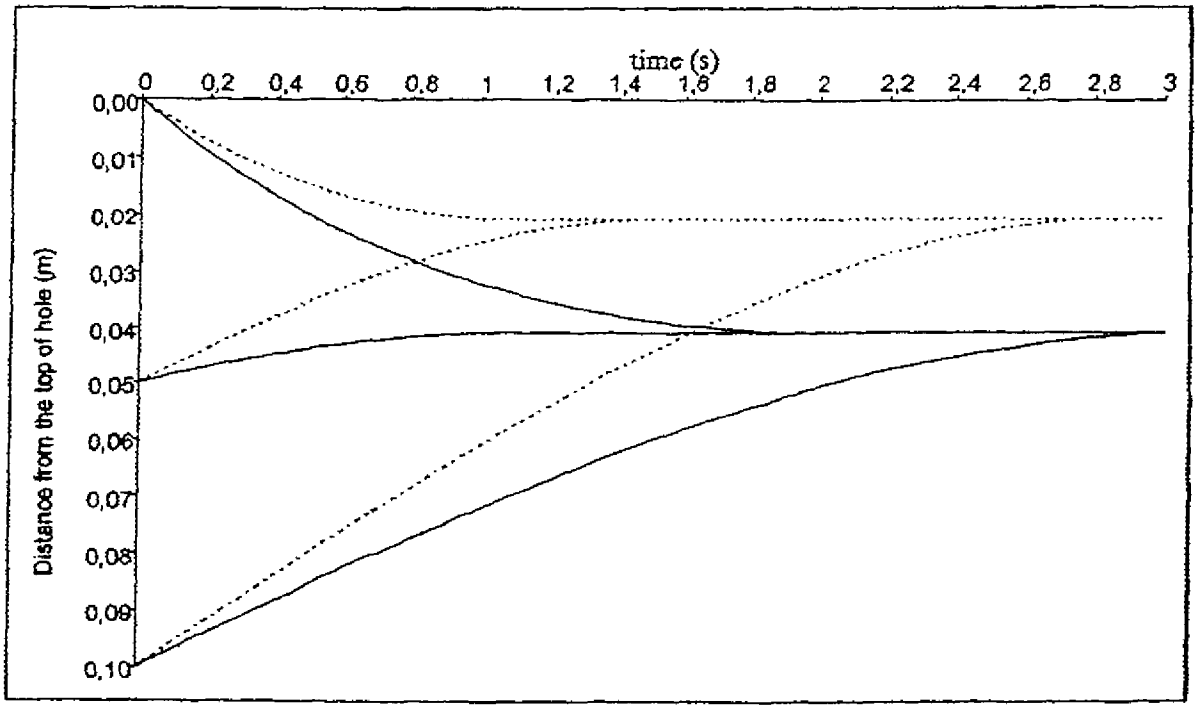
FIG. 3 shows the simulated trajectories of three pairs of PP and PE particles at laminar conditions in a fluid process stream.

FIG. 3 shows the simulated trajectories of three pairs of PP and PE particles at laminar conditions in a fluid process stream from left to right. The solid lines are PE particles and the dotted lines represent PP particles. The results show that the separation is most efficient if the particles to be separated are introduced into the process fluid stream in a small turbulent flow of approximately 10%, roughly at the height of the splitter, which provides a particularly good separation of the PP and PE particles.

The invention will now be further elucidated by way of the following examples.

Example 1

A mixture of approximately 70% PP and approximately 30% PE is obtained by means of floatation-sedimentation separation in water of a quantity of automotive shredder residue, ground into particles of approximately 10 mm diameter, and subsequently moistened with steam (10 kg steam per ton of plastics). The moistened plastics are then mixed with a magnetic process fluid on a basis of water and iron-oxide particles with a magnetization saturation of approximately 300 A/m at a ratio of 10 kg of plastics to 100 liters of process fluid. This mixture is stirred and injected at the height of the splitter, between two strata of laminar flow, in the field below a magnet as in FIG. 1, with the magnetic field under the magnet more or less exponentially decreasing with the distance to the lower surface of the magnet. The (horizontal) rate of the fluid streams and the conveyor belts is 0.3 m/s and the lingering time of the particles in the field up to the splitter is approximately 2 seconds. Above and below the splitter PP and PE products are removed at a purity better than 95%.

Example 2

A mixture of diamond and mineral particles with grain sizes between 0.5 mm and 2.0 mm is moistened with steam and subsequently mixed with a magnetic process fluid on a base of water and iron-oxide particles having a magnetization saturation of approximately 6000 A/m at a ratio of 10 kg of mixture to 100 liters of process fluid. This mixture is stirred and injected at the height of the extractor opening for the diamond-enriched stream, between two laminar stream strata, in the field above a magnet as in FIG. 1, wherein the magnetic field above the magnet in a good approximation exponentially decreases with the distance to the upper surface of the magnet. The (horizontal) rate of the fluid streams and the conveyor belts is 0.3 m/s and the lingering time of the particles in the field up to the splitter is approximately 2 seconds. The diamond-enriched stream is extracted by means of the extractor opening under the splitter.

Attention is drawn to the fact that the invention is in no way limited to the above described embodiments.

What is claimed is:

1. A method for separating solid particles in a process fluid in a magnetic process, wherein the solid particles are separated by adding the solid particles to the process fluid, after which the obtained mixture of particles and fluid is conducted along a magnet configuration, in which method solid particles of different densities are separated, wherein in a first step the solid particles are thoroughly mixed and subsequently supplied to a small turbulent partial flow of a magnetic process fluid, which small turbulent partial flow is added to a large laminar partial flow of the magnetic process fluid, after which the turbulent and laminar magnetic process fluids are conducted along the magnet configuration, wherein the particles are separated into lighter particles at the top of the laminar magnetic process fluid and heavier particles at the bottom of the laminar magnetic process fluid, wherein the lighter particles and the heavier particles are subsequently removed with the aid of a splitter to separate the low density and the high density materials from the magnetic process fluid.

2. A method according to claim 1, wherein prior to mixing in the turbulent fluid stream, the solid particles are subjected to moistening with steam.

3. A method according to claim 1, wherein the turbulent particle stream is introduced at the height of the splitter.

4. A method according to claim 1, wherein heavy particles settled in the process fluid stream are collected and removed at the bottom in a trough-shaped endless conveyor belt.

5. A method according to claim 1, wherein a mixture of polypropylene particles having a density of 880-920 kg/m$^3$ and polyethylene particles having a density of 930-960 kg/m$^3$ are separated.

6. A method according to claim 1, wherein the process fluid consists of a suspension of iron oxide particles.

7. A method according to claim 1, wherein the smaller partial flow constitutes approximately 10% of the process fluid.

8. A method according to claim 1, wherein as the magnet a permanent magnet, electromagnet or a superconducting magnet is used.

9. An apparatus for separating a mixture of materials of little density differences in accordance with the method of claim 1, wherein the apparatus is provided with a mixing vessel for the particles to be separated, which mixing vessel is provided with a stirrer and an outlet for a turbulent partial process stream containing the particles, and laminators and for creating a laminar process stream delimiting the turbulent partial process stream, followed by a magnet for magnetizing the laminar process fluid stream, and a splitter for removing a process fluid stream containing the lighter particles on the one hand, and the heavier particles on the other hand, whereby there is an equidirectionally rotating endless belt for maintaining the laminar process fluid stream, and an equidirectionally moving trough-shaped endless belt for removing the settled heavier particles and for maintaining the laminar process fluid stream.

10. An apparatus according to claim 9, wherein the mixing vessel tapers.

11. An apparatus according to claim 9, wherein the laminators and are provided at the feed side of the fluid stream.

12. An apparatus according to claim 9, wherein the magnet is a permanent magnet, an electromagnet or a superconducting magnet.

* * * * *